US005425837A

United States Patent [19]

Hansch

[11] Patent Number: 5,425,837

[45] Date of Patent: Jun. 20, 1995

[54] APPARATUS FOR DELIVERING SHEET-LIKE PRODUCTS TO A DEVICE FOR PROCESSING PRINTED PRODUCTS

[75] Inventor: Egon Hansch, Wetzikon, Switzerland

[73] Assignee: Ferag AG, Switzerland

[21] Appl. No.: 173,967

[22] Filed: Dec. 23, 1993

[30] Foreign Application Priority Data

Jan. 14, 1993 [CH] Switzerland ..... 00 107/93

[51] Int. Cl.[6] ..... B65H 29/00; B65C 9/00

[52] U.S. Cl. ..... 156/556; 156/571; 156/567; 270/55; 271/204; 271/277

[58] Field of Search ..... 156/556, 566, 567, 568, 156/571; 270/53, 55; 271/204, 205, 206, 277

[56] References Cited

U.S. PATENT DOCUMENTS

| | | | |
|---|---|---|---|
| 3,450,400 | 6/1969 | Guggisberg | 270/55 |
| 3,671,035 | 6/1972 | Reist | 271/76 |
| 3,751,324 | 8/1973 | Enskat | 156/560 |
| 3,826,706 | 7/1974 | Müller | 156/566 |
| 3,871,943 | 3/1975 | Zodrow | 156/521 |
| 3,877,692 | 4/1975 | Kluge et al. | 270/55 |
| 3,955,667 | 5/1976 | Müller et al. | 198/180 |
| 4,201,286 | 5/1980 | Meier | 198/461 |
| 4,533,132 | 8/1985 | Wangermann | 270/53 |
| 4,629,175 | 12/1986 | Fischer et al. | 271/202 |
| 4,746,007 | 5/1988 | Houseman | 198/470.1 |
| 4,852,722 | 8/1989 | Houseman | 198/803.7 |
| 4,893,805 | 1/1990 | Eberle | 27/204 |
| 4,905,818 | 3/1990 | Houseman | 198/803.7 |
| 4,905,986 | 3/1990 | Müller | 271/277 |
| 4,981,291 | 1/1991 | Honegger et al. | 270/55 |
| 4,982,944 | 1/1991 | Eberle | 271/204 |
| 5,022,954 | 6/1991 | Plaessmann | 156/542 |
| 5,052,666 | 10/1991 | Hänsch | 270/55 |
| 5,094,438 | 3/1992 | Reist et al. | 270/55 |
| 5,104,108 | 4/1992 | Honegger | 270/55 |
| 5,110,108 | 5/1992 | Müller | 271/69 |
| 5,116,452 | 5/1992 | Eder | 156/566 |
| 5,137,596 | 8/1992 | Potter | 156/497 |
| 5,275,685 | 1/1994 | Stauber | 156/556 |

FOREIGN PATENT DOCUMENTS

| | | |
|---|---|---|
| 2049850 | 4/1972 | Germany . |
| 2160772 | 6/1973 | Germany . |
| 2135303 | 8/1973 | Germany . |

*Primary Examiner*—James J. Engel

*Attorney, Agent, or Firm*—Willian Brinks Hofer Gilson & Lione

[57] ABSTRACT

An apparatus for delivering sheet-like products to a device for processing printed products comprising a conveying device for transporting the products, a rotating transfer conveyor for receiving the products from the conveying device, at least one controllable clamp located on the transfer conveyer and capable of swiveling during rotation of the transfer conveyor and a processing device for receiving the products from the transfer conveyor and printing.

18 Claims, 14 Drawing Sheets

APPARATUS FOR DELIVERING SHEET-LIKE PRODUCTS TO A DEVICE FOR PROCESSING PRINTED PRODUCTS

BACKGROUND OF THE INVENTION

The present invention relates to an apparatus for delivering sheet-like products to a device for processing printed products.

The prior art contains many examples of machines used to transport printed products. U.S. patent application Ser. No. 08/028,760, now U.S. Pat. No. 5,275,685, a continuation of application Ser. No. 07/960,589 entitled "Apparatus for gluing attachment slips to printed products" discloses one such apparatus. That application teaches a machine with a belt conveyor, which feeds spaced-apart supplements to a takeover region. The supplements are conveyed past an adhesive-applying device by a transfer conveyor. The supplements are eventually fed to a processing device of a drum-like design. A transfer conveyor lifts the supplement up to the printed products and presses the supplements against the printed products for adhesive attachment. The transfer conveyor utilizes a plurality of flat holders with suction heads or controlled grippers for retaining and conveying the supplements. The holders are pivotally mounted on swivel levers, which are articulated on a wheel-like rotatingly driven carrying member. Guiding bars also engage the holders. The opposite end of the guiding bars is swivel-mounted on the carrying member which is coupled to an epicyclic gear in order to control the swiveling position. In the takeover region, the holders are directed approximately tangentially with respect to their circulating path. During the course of approximately half a revolution of the carrying member by the epicyclic gear, the holders are swiveled through approximately 90°. The holders swivel in the same direction as the carrying member, so that they are then directed approximately at right angles with respect to their circulating path. At the same time, each holder is moved forward in the circulating direction with respect to the carrying member, so as to push the supplement against a printed product deposited astride the saddle-shaped rest on the processing device. The holder then releases the adhesively attached supplement and moves to the takeover region in order to retain another supplement.

Another prior art device for adhesively attaching sheet-like products is disclosed in German Patent DE-A-21 35 303. Two feeding heads, equipped with a gripper device, are fixed to a continuous, circulating conveying member. The gripper devices remove a product from a magazine and firmly hold the same until the feeding heads are set onto the printed products to which the product is to be adhesively attached. The printed products are transported by a processing conveyor which is parallel to the strand of the conveying member and moves in the same direction and at the same speed as the conveying member.

Furthermore, U.S. Pat. Nos. 4,982,944 and 4,893,805, as well as corresponding European Patents EP-A-0,312,755 and EP-A-O,305,671, disclose an apparatus utilizing a conveying device with individually controllable grippers, which are arranged one behind the other, to move printed products to a take over region. The transfer conveyor has takeover grippers fastened at regular intervals on a driven endless drawing member. The takeover grippers have a moveable jaw which, in the open position, is swiveled laterally away from the assigned fixed jaw. In the closed position, the moveable jaw assumes the same direction as the fixed jaw. In the takeover region, the transfer conveyor moves in the same direction as the conveying device. The grippers on the conveying device move in the opposite direction of the takeover grippers on the transfer conveyor. This enables the takeover grippers to seize the printed products at their trailing edge and feed them to a winding device which winds them onto a core.

One object of the present invention is to provide an apparatus capable of delivering sheet-like products to different types of devices for processing printed products. Ideally, this objective will be met despite low space requirements.

Another object of the present invention is to provide an apparatus with easily controllable clamps.

A third object is to provide an efficient device that ensures secure adhesive attachment of the product to the printed product without damaging the product.

A fourth object of the present invention is to allow transportation of products of varying thicknesses.

SUMMARY OF THE INVENTION

The present invention includes an apparatus for delivering sheet-like products to a device for processing printed products. The apparatus comprises a conveying device for transporting the products and a rotating transfer conveyor which is located adjacent the conveying device. The conveying device receives the products from the conveying device. At least one controllable clamp is articulated on the transfer conveyor. The clamp includes a clamp mouth for seizing the products and the clamp has the capability of swiveling during rotation of the transfer conveyor. A processing device is located adjacent the transfer conveyor and opposite the conveying device for receiving the products from the transfer conveyor.

One advantage of the apparatus of the present invention is that due to the wheel-like design of a carrying member which is part of the transfer conveyor. The apparatus is space-saving and uncomplicated.

These and other advantages, as well as the invention itself, will be best understood in view of the attached drawings, a brief description of which follows.

DETAILED DESCRIPTION OF THE PRESENTLY PREFERRED EMBODIMENTS OF THE INVENTION

Figure 1:
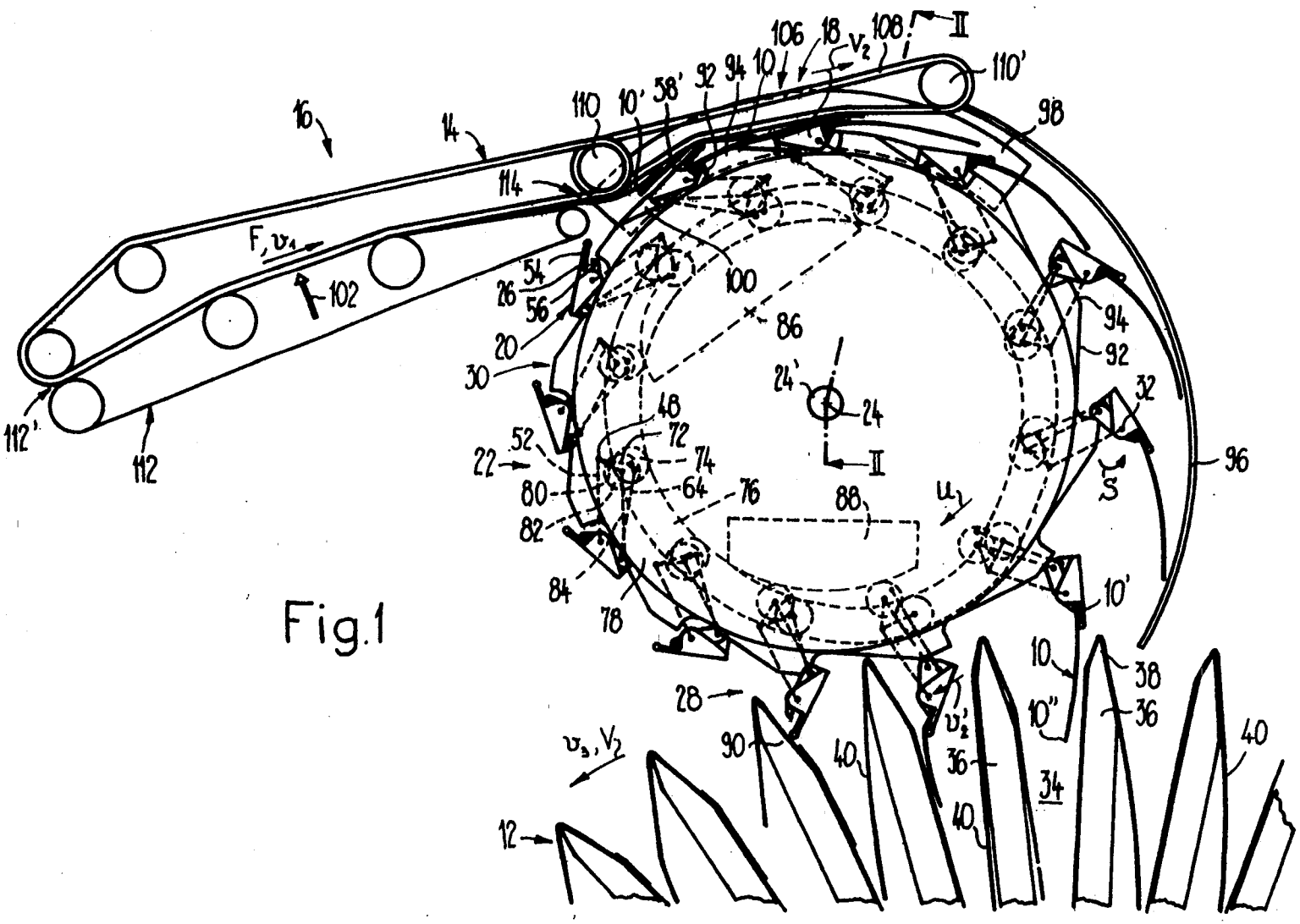
FIG. 1 Is a perspective view of a preferred embodiment of the invention.
Figure 2:
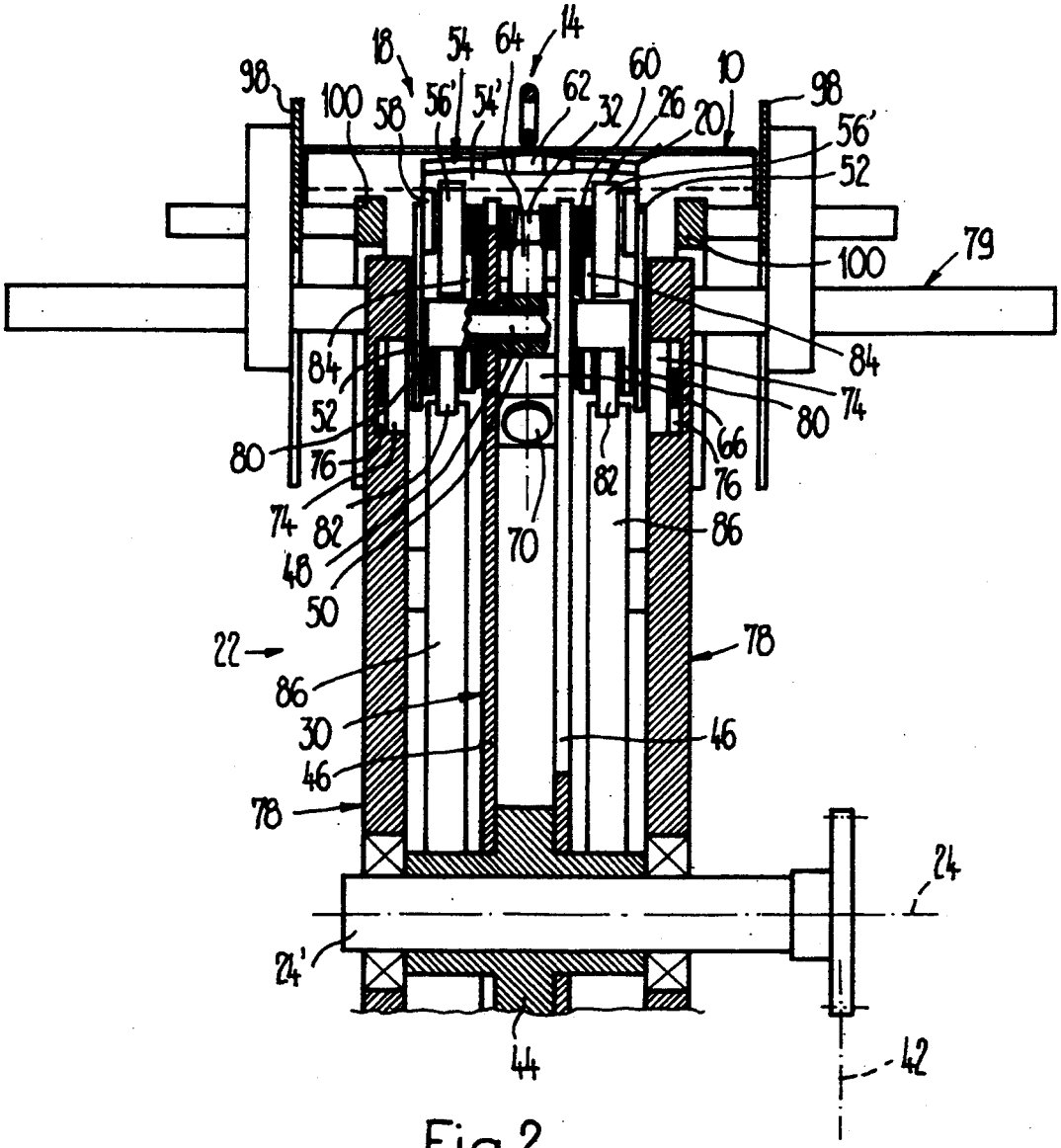
FIG. 2 is a cross-sectional view of the apparatus of FIG. 1 taken along the line II—II.

Referring to FIG. 1, an apparatus for delivering sheet-like products 10, in the present case cards, to a processing device 12 is depicted. A conveying device 16, such as belt conveyor 14, transports the products 10 in conveying direction F and at conveying speed $v_1$, to a takeover region 18. Transfer conveyor 22 is placed underneath the conveying device 16 causing the conveying device 16 to rise slightly. Transfer conveyor 22, equipped with individually controllable clamps 20, rotates in direction U about the axis of rotation 24. In the takeover region 18, the clamps 20 move in the conveying direction F. Therefore, the clamp mouth 26 is directed forward. The clamp speed $v_2$ is greater than the conveying speed $v_1$. As will be described in further detail below, in the transfer region 18, each clamp 20 retains a product 10 at the product's 10 trailing edge 10'. The clamp 20 transports the product 10 to the transfer region 28, which is approximately opposite to the takeover region 18. The clamps are situated on a wheel-like carrying member 30. During the course of movement of clamps 20 from the takeover region 18 to the transfer region 28, the clamps 20 are swiveled counter to the rotating direction U about a swivel axis 32 which runs parallel to the axis of rotation 24. This facilitates insertion of the products 10 by their leading edge 10" into the pocket-shaped receiving parts 34 of the processing device 12. Receiving parts 34 are bound by walls 36 which run in the radial direction. The outer edge of walls 36 bear on saddle-like rests 38, which run parallel to the horizontal axis of rotation (not shown) of the processing device 12. Printing products 40 are folded and deposited on rests 38 in a straddle-like manner. A product 10 may be adhesively attached to each printing product 40 in transfer region 28. A drum-like processing device 12 of this type is disclosed in U.S. patent application Ser. No. 07/997,856 and the corresponding European Patent Application, Publication No. 0 550 828. As far as the design and operating principle of the processing device 12 are concerned, these documents are incorporated by reference. Drum-like processing devices are also taught by European Patents EP-A0,341,425, EP-A-0,341,424 and EP-A-0,346,578, as well as the corresponding U.S. Pat. Nos. 5,052,667, 5,052,666 and 5,104,108, which documents are also incorporated by reference.

Referring now to FIGS. 1—5, the design of transfer conveyor 22 is described in more detail. Rotary shaft 24' is coaxial to the axis of rotation 24 and is continuously driven in rotating direction U by means of a chain drive 42. A keyed-on bearing element 44 is located on rotary shaft 24'. Wheel-like carrying member 30 is seated on bearing element 44 in a rotationally fixed manner. The wheel-like carrying member 30 possesses two parallel round carrying disks 46, which run at right angles to the axis of rotation 24 and pass through bearing shafts 48. In the preferred embodiment, there are twelve such shafts, at fixed intervals on a pitch circle coaxial to the axis of rotation 24. The spacing of the carrying disks 46 may be determined by the bearing element 44 and by spacers 50, which pass through bearing shafts 48. A swivel lever 52 is fastened on carrying disks 46 located at both ends of the bearing shafts 48. The swivel levers 52, mutually parallel in each case, are connected to each other at their free ends by means of the swivel spindle 32.

Plate-like first clamping jaw 54 and second clamping jaw 56 are rotatably mounted on swivel spindle 32. Second clamping jaw 56 comprises two clamping fingers 56. The first clamping jaw 54 is connected to plates 58 which pass through the swivel spindle 32. The plates 58 are formed on the flat clamping jaw part 54' and protrude at right angles from the latter. The clamping fingers 56' are of a double-lever-like design and also pass through the swivel spindle 32. The first clamping jaw 54 projects beyond the actively clamping lever arm of the clamping fingers 56'. A helical spring 60 is located between the first clamping jaw 54 and the clamping fingers 56'. Spring 60 encloses the swivel spindle 32 thereby prestressing the two clamping jaws 54, 56 toward each other in the closing direction.

Figure 3:
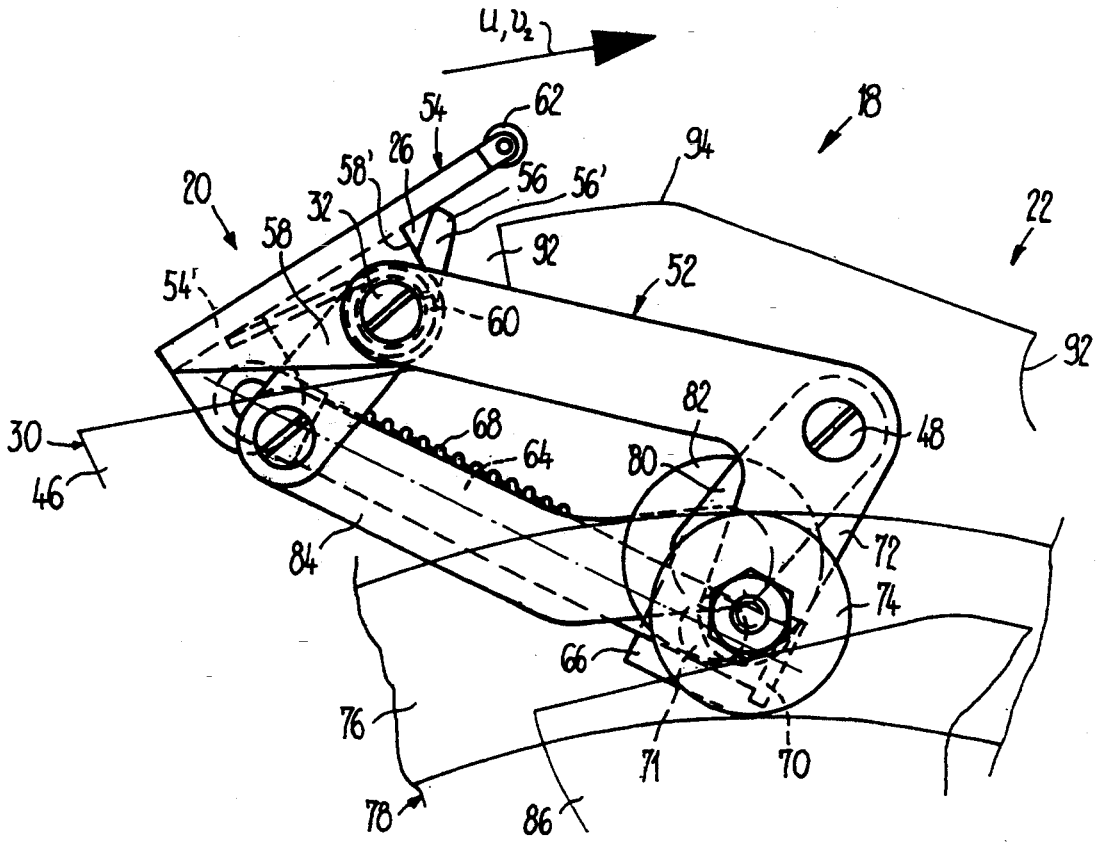
FIG. 3 is an enlarged view of a clamp of FIG. 1 in the takeover position.
Figure 5:
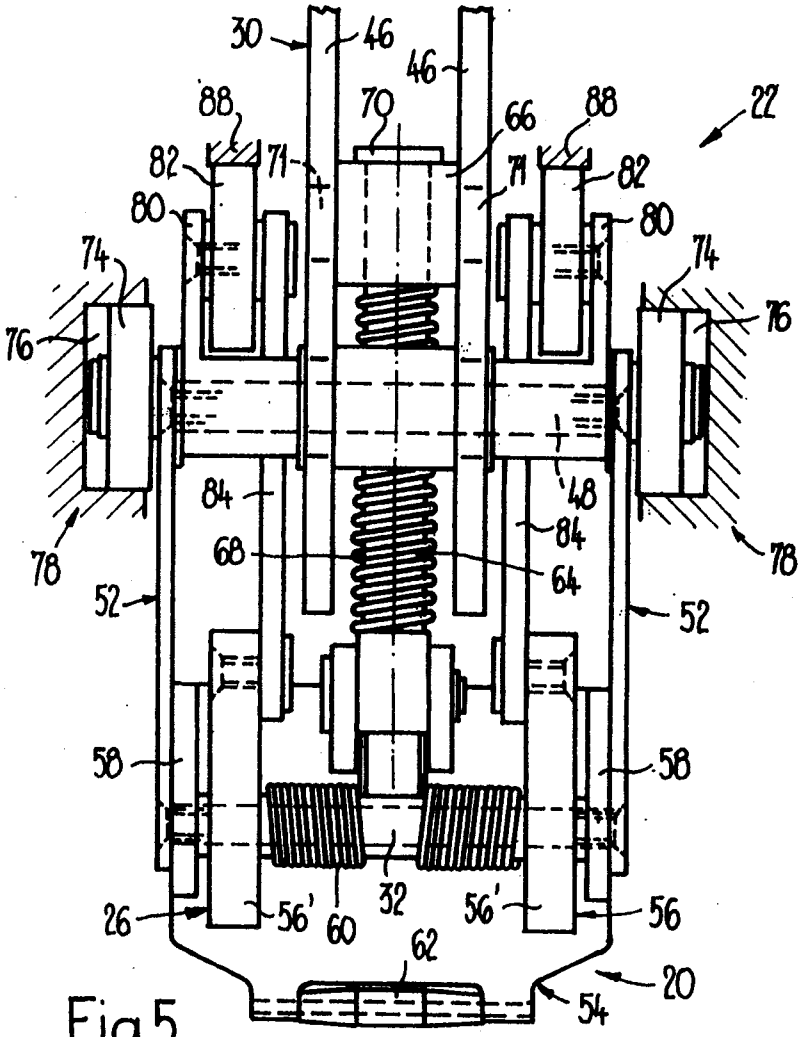
FIG. 5 is a side view of the clamp of FIG. 4 taken in the direction of arrow V.

As depicted in FIGS. 1 and 3, in the takeover region 18, the clamp mouth 26, which is formed by the clamping jaws 54, 56, is directed forward in rotating direction U. First clamping jaw 54 has a freely rotatably mounted pressing roller 62 which projects beyond clamping fingers 56. The longitudinal axis of pressing roller 62 runs parallel to the axis of rotation 24 and swivel axis 32.

Guiding bar 64 is attached to the first clamping jaw 54 at the end opposite pressing roller 62. The guiding bar 64 is shank-like and passes through bearing element 66, which is located between and rotatably mounted on the carrying disks 46. The guiding bar 64 is engaged by a spring element 68. In preferred embodiment, the spring is a compression spring. Spring 68 is supported at one end by the bearing element 66 and at the other end on the guiding bar 64. The guiding bar 64 passes freely through the bearing element 66 and rests on a stop disk 70. Stop disk 70 interacts with the bearing element 66 to set the clamp guiding position of the guiding bar 64. The bearing element 66 is swivel-mounted on the carrying member 30 by journal 71. Journal 71 is radially offset inward with respect to the bearing shaft 48 and counter to the rotating direction U. Hence, the first clamping jaw 54 is positioned on the carrying member 30 in the manner of a crank gear: the swivel levers 52 forming the crank, the guiding bar 64 forming the rocker and the first clamping jaw 54 forming the connecting rod.

Control arm 72 is formed onto the swivel levers 52 at an angle. The free end of control arm 72 bears against a freely rotatable control roller 74. The opposite side of the control arm 72, i.e., the side facing away from the clamping jaws 54, 56 also bears against freely rotatable control roller 74. The control rollers 74 move along enclosed, slot-like control links or cams 76 or which encircle the rotary shaft 24'. The control links or cams 76 are formed onto link plates 78 which are parallel to the carrying disks 46. The link plates 78 are supported by a frame 79 and the rotary shaft 24' is rotatably mounted on them.

As illustrated in FIGS. 1 and 3, the control links 76 are configured so that when in the takeover region 18, the swivel levers 52 swivel counter to the rotating direction U and thereby assume a rearward takeover position. In this instance, the clamps 20, which are controlled by the guiding bars 64, are swiveled so that the clamp mouth 26 is directed forward in rotating direction U. This clamp 20 position may be referred to as the takeover position. In the preferred embodiment, the planar first clamping jaw 54 forms a forwardly open acute angle equal to about 10°.

Figure 4:
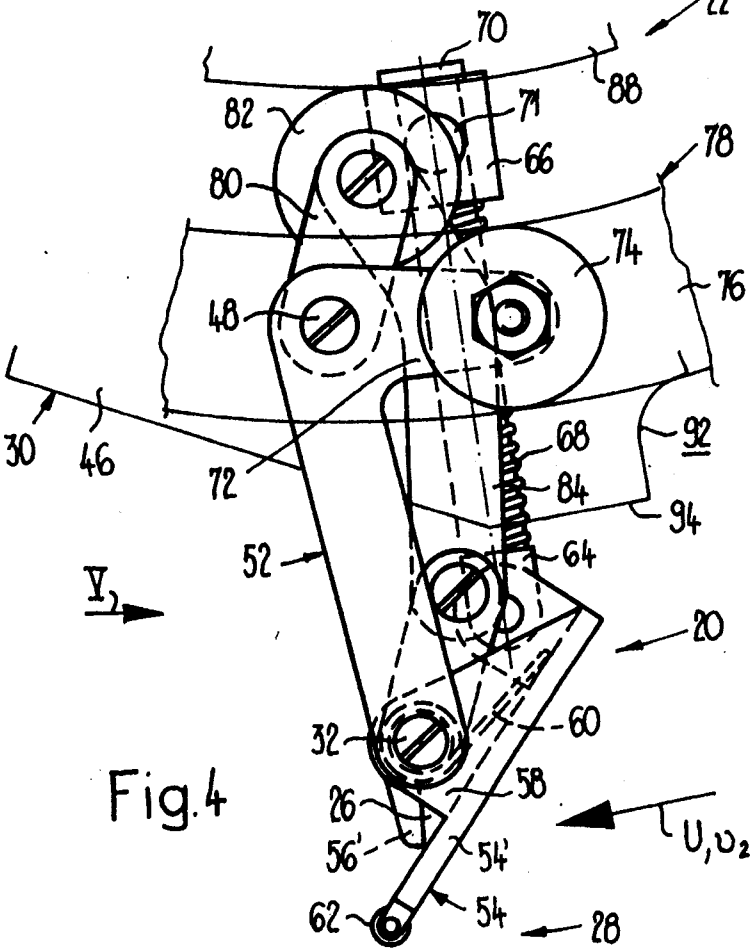
FIG. 4 is an enlarged view of the clamp of FIG. 3 in the transfer position.

When rotating in direction U between the takeover region 18 and the transfer region 28, the control links 76 are shaped so that the guiding bars 64 swivel forward in rotating direction U, into a transfer position. When in the transfer position, the guiding bars 64 assume a longitudinal direction which is approximately radial with respect to the axis of rotation 24. Consequently, the first clamping jaw 54 and the clamp 20 swivel in a swiveling direction S, which is opposite the rotating direction U. Therefore, the angle formed by the first clamping jaw 54 and a tangent to the path of rotation increases, as shown in FIG. 4 (in the transfer position this angle is preferably about 60–70°).

A crank 80 is rotatably mounted on the bearing shaft 48 between the carrying disk 46 and the swivel lever 52. A freely rotatable follow-up roller 82 is attached to the end of crank 80. A connecting rod 84 connects the crank 80 to the clamping finger 56' of the second clamping jaw 56. In the preferred embodiment, the connecting rods 84 are articulated on the clamping fingers 56' away from the actively clamping arm. Opening links 86, which are fastened on link plates 78, interact with follow-up rollers 82 in the takeover region 18. Likewise, in the transfer region 28 there are follow-up links 88, which interact with the follow-up rollers 82 to prevent swiveling of the second clamping jaw 56 when the first clamping jaw 54 is opened by counter bearings 90. In the preferred embodiment, the counter bearings 90 are formed by the walls 36, or rests 38, as depicted in FIG. 1.

In the takeover position, clamps 20 engage recesses 92 which are located on the circumference of the carrying disks 46. The outer surface 94 of the sawtooth-like projections between the clamps 20 forms a guiding member for the trailing edge 10' of the products 10. As illustrated in FIG. 1, the outer surface 94 at the free end of the second clamping jaw 56 lines up with the clamping jaw 56.

The inner end of the clamp mouth 26 is formed by the plates 58, the leading edge 58' of which forms a stop for the trailing edge 10' of the products 10. Between the takeover region 18 and the transfer region 28 there is a guide plate 96, which guides the leading edge 10'' of the products 10 during transport and prevents rearward bending of the products 10. In addition, in the takeover region 18, lateral guide plates 98 are fastened to the frame 79 on both sides of the path of clamp 20 rotation. The lateral guide plates 98 assume a lateral directing function during the takeover by the transfer conveyor 22. Furthermore, in the takeover region 18, guide profiles 100 are fastened on the frame and arranged coaxially to the axis of rotation 24, between the lateral guide plates 98 and the path of rotation of the clamps 20° The guide profiles 100 support the products 10 on the inner-lying side.

Figure 6:
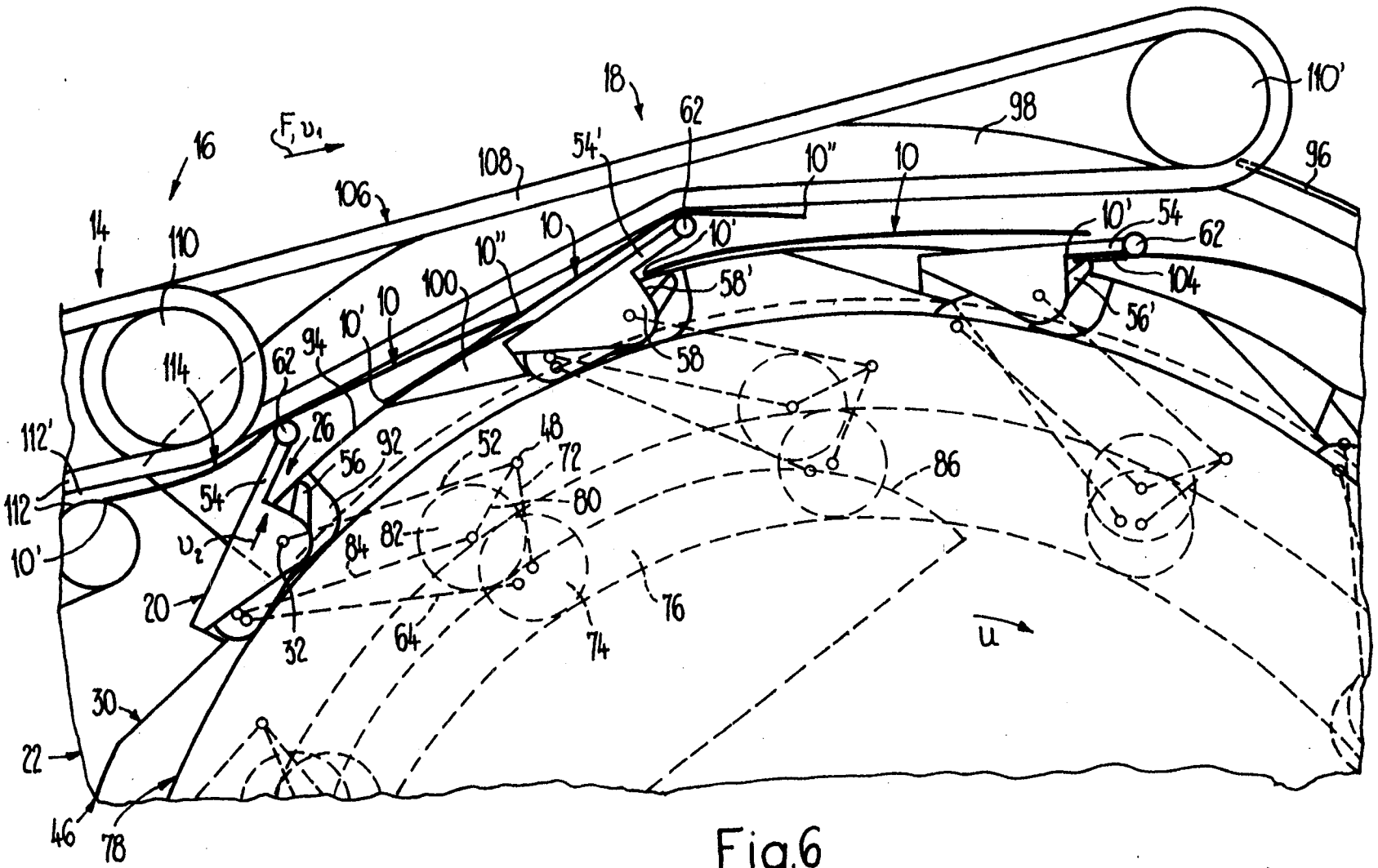
FIGS. 6 and 7 are enlarged views of the takeover region of the apparatus of FIG. 1 at two points in time half a working cycle apart.

In the preferred embodiment, an adhesive applying device 102, depicted by an arrow in FIG. 1, is located proximal to the transfer conveyor 22. The application of adhesive 104 is indicated in FIG. 6. The adhesive applying device 102 may be activated in any known manner. Preferably, the adhesive is applied when the product 10 is seized by a clamp 20. More preferably, the adhesive 104 is applied to the side of the product 10 that faces the axis of rotation 24. Applying the adhesive 104 at this point has many advantages, which will be described further in conjunction with the transfer of the products 10 to the device 12. In principle, however, it is also possible for the adhesive applying device 102 to provide the adhesive 104 at another time. If the products 10 are not going to be adhesively attached to the printing products, the adhesive applying device 102 is switched off, or the adhesive applying device 102 may be entirely omitted from the apparatus.

The conveying device 16 possesses a strap conveyor 106. Preferably, the strap conveyor 106 is a flexible, endless, cross-sectionally round conveyor strap 108. Conveyor strap 108 is led around deflecting rollers 110, 110' at the beginning and end of the takeover region 18. Taken together, the conveyor strap 108 and the pressing roller 62 of the clamps 20 form a clamping nip for the products 10. The belt conveyor 14, which is located at the proximal end of strap conveyor 106, has a pair of conveyor belts 112 which form a conveying nip 112'. The conveying nip 112' feeds the products 10, in conveying direction F, to the pair of conveyor belts 112 which are driven in a circulating manner at the conveying speed $v_1$. Conveying speed $v_1$, is less than the speed $v_2$ of the clamps 20 in the takeover region 18.

Figure 7:
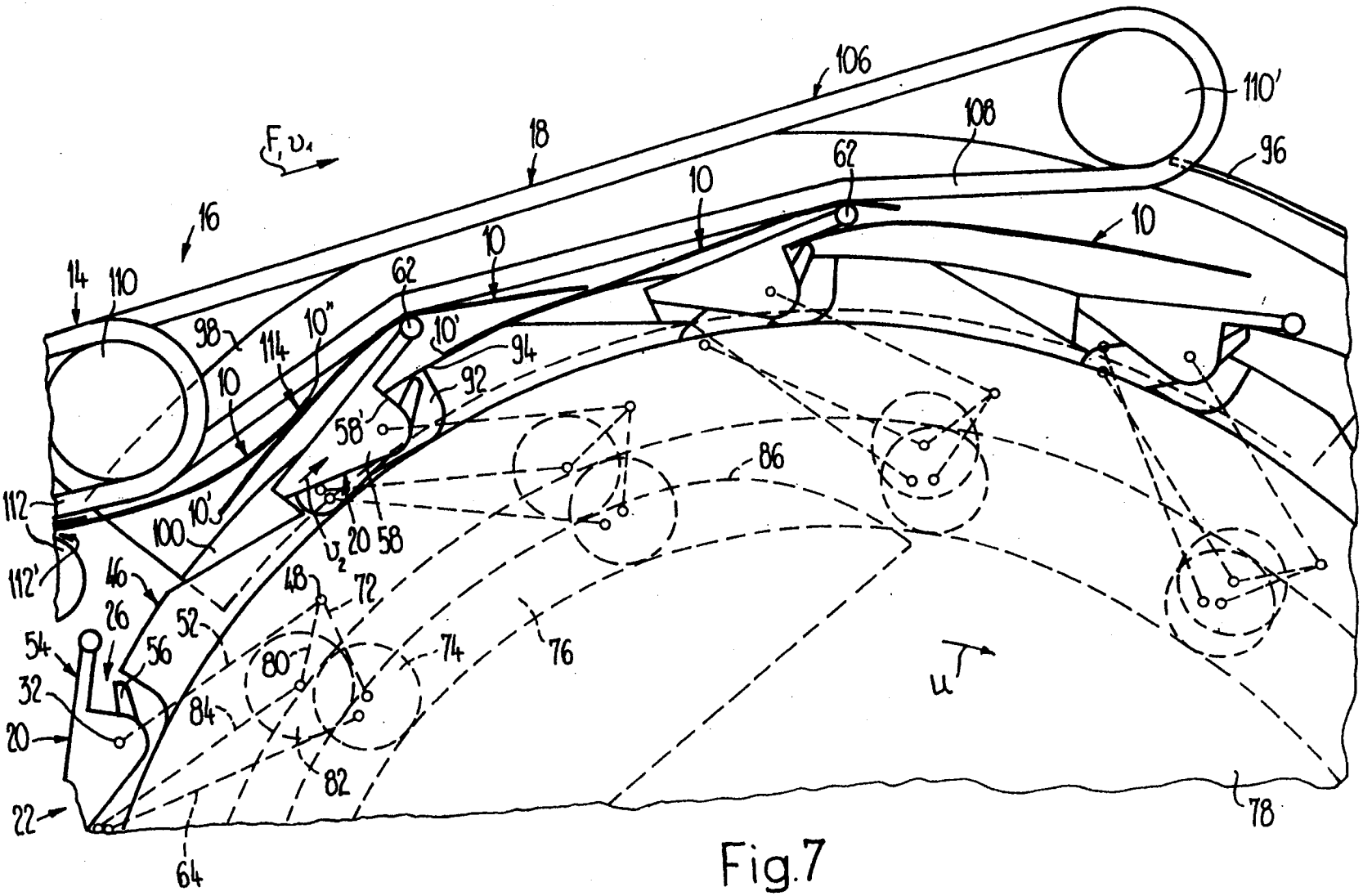

As shown in FIGS. 1, 6 and 7, the products 10 are fed to the takeover region 18 by the conveying device 16 in an imbricated formation 114. Consequently, the trailing edge 10' of each product 10 rests on the following product 10, on the side facing away from the strap conveyor 106.

Retention of the product 10 by the transfer conveyor 22 is now explained with reference to FIGS. 6 and 7 which represent the takeover region 18 at two points in time half a working cycle apart. When a product 10 leaves the conveying nip 112', its leading edge 10'' passes directly into the takeover region 18, where it rests on the preceding product 10. The product 10, however, is still held in the conveying nip 112' and further transported at the conveying speed $v_1$ (cf. FIG. 7). As a consequence of the higher clamp speed $v_2$, a clamp 20 then advances to the product 10. The pressing roller 62 of clamp 20 presses the product 10 against the conveying strap 108. During rotation, the pressing roller 62 continues to press the product 10 against the conveying strap 108, thus enabling retention of the product 10 when its trailing edge 10' has left the conveying nip 112'. The flexibility of the conveying strap 108 and the fact that the path of the pressing roller 62 intersects the imaginary straight line of the conveying strap 108 between the deflecting rollers 110 and 110', causes the conveying strap to deflect upward. This results in the bending of product 10. Therefore, the trailing edge 10' of product 10 rests on the guide profiles 100 and the outer surface 94 of the carrying disks 46. (see the central clamp 10 in FIG. 6.) The products 10 are still transported at the conveying speed $v_1$. The pressing roller 62 rolls on the conveying strap 108 and the next opened mouth clamp 20 advances to the product 10 and grasps around it at its trailing edge 10'. At the end of the takeover region 18, the pressing roller 62, which is pressing the product 10 against the conveying strap 108, runs off the conveying strap 108 and the associated clamp 20 closes in order to seize and firmly hold the product 10 at the trailing edge 10'. (See FIG. 6, clamp 20 on the far right and FIG. 7, the two clamps 20 on the right.)

The products 10 are consequently retained and guided until they are seized by a clamp 20. This enhances the processing capacity of the apparatus. The clamps 20 seize the product 10 securely. Because the products 10 are bent and the conveying strap 108 is raised, the trailing edge 10' of the product 10 will always be grasped by the first clamping jaw 54. Furthermore, the guide profiles 100 and the outer surface 94 ensure that the second clamping jaw 56 engages underneath the product 10. Furthermore, exact alignment of the products 10 is ensured by the fact that the plates 58 run with their edge 58' on the trailing edge 10' of the products 10. Any turning, or lateral deviation of the products 10 is prevented by the guide surface 98.

One advantage of the apparatus of the present invention is that due to the wheel-like design of the carrying member, the apparatus is space-saving and simple in design.

A second advantage lies in the fact that the clamps are controllable. Because the clamps swivel, the products can be both deposited on a conveyor belt and inserted into pocket-like receiving parts of the processing device. Furthermore, with an appropriate design of the clamps, this apparatus also allows products to be pressed onto the processing device.

A third advantage lies in the ease of controlling the position of the clamps.

Another advantage lies in the simple, reliable takeover of the products in the takeover region at a high processing speed and pressing of the products against a counter bearing of the processing device in the takeover region. As a result, secure adhesive attachment of the products to printing products is ensured.

Yet another advantage resides in that the apparatus of the present invention allows transportation of products with different thicknesses. The apparatus also accommodates the pressing of these products against a counter bearing without damage and without the necessity of setting work.

The design of the pressing roller produces another advantage of the present invention. The pressing roller ensures secure adhesive attachment of the products without damaging them.

Figure 8:
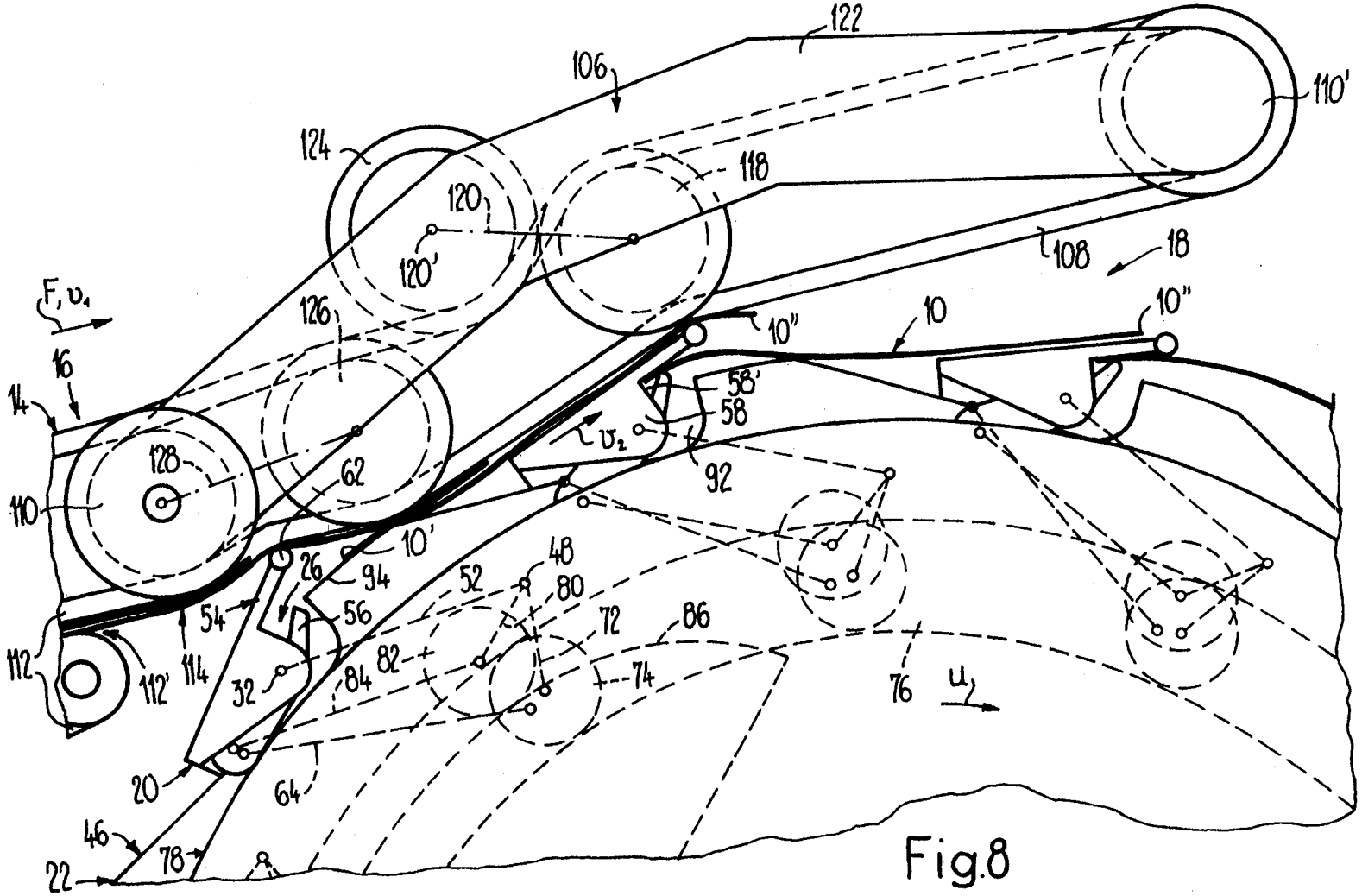
FIGS. 8 and 9 are enlarged views of another preferred embodiment of the takeover region of the apparatus of FIG. 1.
Figure 9:
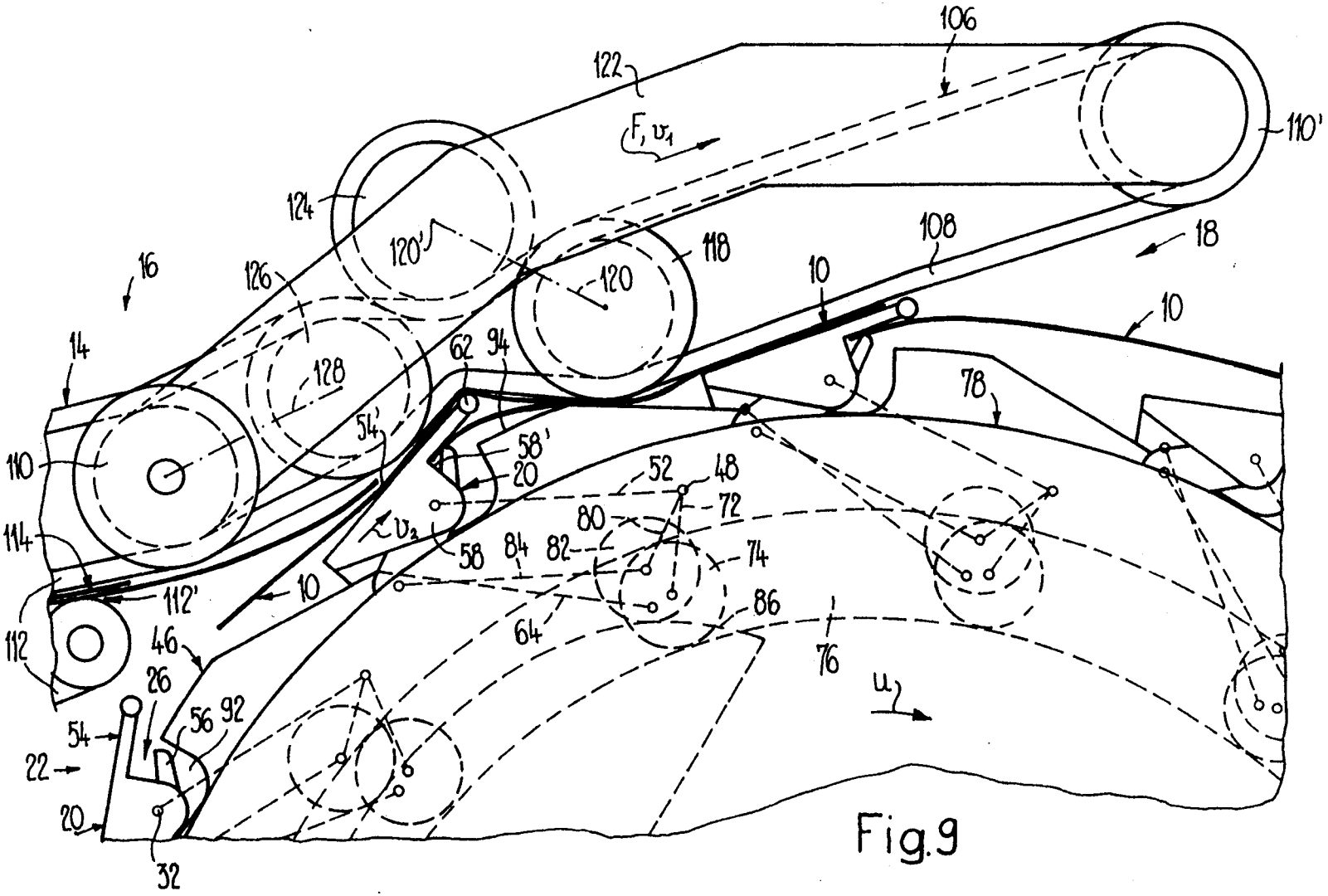

Another embodiment of the apparatus is shown in FIGS. 8 and 9. The conveying strap 108 of the strap conveyor 106 is led around fixed deflecting rollers 110 and 110'. Deflecting roller 110 is located at the end of the conveying nip 112' while deflecting roller 110' is positioned at the end of the takeover region 18. Both deflecting rollers 110, 110' are driven in conveying direction F at the conveying speed $v_1$. Centrally located between the deflecting rollers 110 and 110' is a first pressing wheel 118. First pressing wheel 118 is mounted on the free end of lever 120. First pressing wheel 118 is freely rotatable and lies between the two strands of the conveying strap 108. The other end of lever 120 is swivel-articulated on a bearing plate 122 of the conveying device 16. A tensioning wheel 124 is mounted about the swivel axis 120' of lever 120. The tensioning wheel 124 is also freely rotatable. The tensioning wheel 124 presses the upper, non-active strand of the conveying strap 108 toward the lower active strand. Furthermore, between these two strands and also between the tensioning wheel 124 and the deflecting roller 110 a second pressing wheel 126 is positioned. The second pressing wheel 126 is freely rotatable and mounted at the free end of lever 128. Lever 128 is swivel-mounted about the axis of the deflecting roller 110. Therefore, between the deflecting rollers 110 and 110' there are two flexibly compliant supports, which press the conveying strap 108 in the downward direction, toward the transfer conveyor 22. In each case, the downwardly acting force is generated by the upper, non-active strand of the conveying strap 108, which flexibly prestresses the pressing wheels 118, 126 downward on account of tensioning wheel 124.

With the embodiment shown in FIGS. 8 and 9, the takeover of the products 10, fed by the conveying device 16, is performed by the clamps 20 of the transfer conveyor 22 in fundamentally the same manner as in the case of the embodiment according to FIGS. 6 and 7. The processing capacity of the apparatus is enhanced because of the multiple, flexible support of the conveying strap 108. A greater conveying speed $v_1$ and greater clamp speed $v_2$ are permissible with the same reliable and secure takeover of the products 10. Furthermore, the products 10 are retained over a longer distance.

A product 10 respectively leaving the conveying nip 112' of the pair of conveyor belts 112 (FIG. 9) is retained by a clamp 20 and pressed by the pressing roller 62 against the conveying strap 108 before the trailing edge 10' leaves the conveying nip 112' (FIG. 8). The product 10 is transported at the conveying rate $v_1$ due to the higher clamp speed $v_2$, an opened clamp 20 advances to the product 10 and holds it in the region of the trailing edge 10' . Because the deflecting roller 62 deflects the conveying strap 108 in the upward direction, the product 10 is bent. The pressing wheel 126 presses the product downward, against the upper side of the clamping jaw 54' (FIG. 9) and the outer surface 94 of the carrying disks 46. The S-shaped guidance of the conveying strap 108, particularly between the deflecting roller 110 and the first pressing wheel 118, enhances the detaching effect of the trailing region of the product 10 from the following product 10. As soon as the clamp 20 advances to the respective product 10, it is closed in order to seize the product 10 at the trailing edge 10' and hold it securely during further transportation. This is clearly depicted in FIG. 9.

Since the products 10 in the takeover region 18 are not displaced relative to one another, larger products can also be processed. Larger products are pressed by two clamps 20 against the strap conveyor 106. It is also conceivable to process products 10 which are fed into the takeover region 18 at a distance from one another. When there is a distance between products it is advantageous to use the embodiment depicted in FIGS. 8 and 9, since the products 10 are held by the pressing rollers 62, the clamping jaw part 54' and the carrying disks 46. In this instance, material is chosen so that the friction between the products 10 and the strap conveyor 106 is significantly greater than the friction between the products 10 and the corresponding parts of the transfer conveyor 22.

Figure 10:
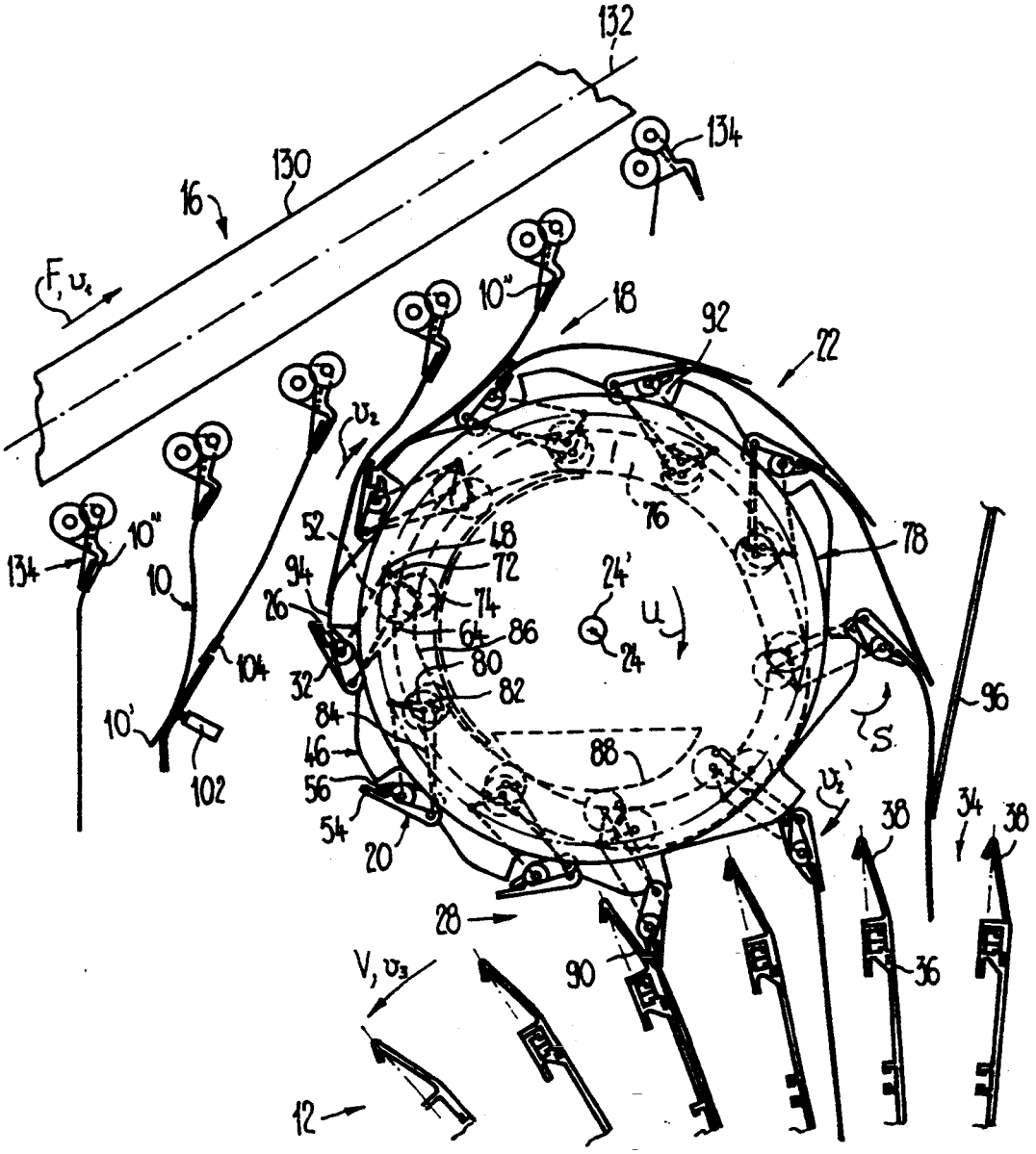
FIG. 10 is a perspective view of another embodiment of the present invention.

FIG. 10 shows another variation of the apparatus of FIG. 1. In FIG. 10, the conveying device 16 transporting the products 10 to the takeover region 18 is designed as a gripper conveyor. The gripper conveyor has an endless drawing member 132 (indicated by dot-dashed lines), which is guided in a channel 130. The drawing member 132 is driven in conveying direction F at the conveying speed $v_1$. Individually controllable grippers 134 are fastened at fixed intervals, one behind the other, on the drawing member 132. Grippers 134 of this type are disclosed, for example, in Swiss Patent Applications Nos. 00 495/92-8 and 00 496/92-0. Each gripper 134 holds a product 10 at its upper edge, which becomes the leading edge 10'' when the product 10 is supported in the otherwise freely hanging region of the lower edge, which then becomes the trailing edge 10'.

Arranged underneath the conveying device 16 is the transfer conveyor 22, which is substantially the same as the transfer conveyor described and shown in FIGS. 1 to 5. The differences between the two transfer conveyors will be described below.

Clamps 20 are located on the carrying disks 46 by means of swivel levers 52. The carrying disks 46 are seated on the rotary shaft 24' and driven in rotating direction U. The swivel position of the clamp about the swivel spindle 32 is controlled by a guiding bar 64. The guiding bar 64 engages the first clamping jaw 54. The swivel position of the swivel lever 52 is determined by the control roller 74 which is guided in the control unit 76 of the link plate 78. The second clamping jaw 56 is prestressed in the closed position against the first clamping jaw 54. The second clamping jaw 56 is brought into the open position by the opening link 86, which interacts with the follow-up roller 82. The follow-up roller 82 is mounted on the crank 80 and connected to the second clamping jaw 56 via the connecting rod 84. Furthermore, a follow-up link 88 is provided, which interacts with the follow-up roller 82 in the transfer region 28. In contrast to the embodiment described above, the clamps 20 have no pressing roller 62 on the first clamping jaw 54. Furthermore, no lateral guide surfaces 98 and guide profiles 100 are provided. The guide plate 96 guide the products 10 once they are inserted into the receiving parts 34 of the processing device 12.

The adhesive applying device 102, contacts the products 10 just before they reach the transfer conveyor 22. Measured in the vertical direction, the distance of the adhesive applying device 102 from the circulating path of the grippers 134 is smaller than the length of the products 10. Therefore, the products 10 can be drawn in a sliding manner with their trailing edge 10' over the adhesive applying device 102. The distance between the conveying device 16 and the conveyor 22 is significantly less than the length of the products 10. Consequently, the product 10 fed to the takeover region 18 rests with its central region on a clamp 20 and with its trailing edge 10' on the outer surface 94 of the carrying disks 46 which follow the clamp 20. As a result, the products 10 are raised, which causes the speed of the trailing edge 10' to be temporarily reduced with respect to the conveying speed $v_1$ of the grippers 134. The slower product speed and the higher clamp speed $v_2$, taken together, result in the clamp 20 following the respective outer surface 94 advancing upon the product 10. The opened clamp mouth 26 engages the product 10 by its trailing edge 10'. The shape of the opening link 86 controls the clamp 20 which is closed and the gripper 134 which is open. The product 10 is then fed, by the transfer conveyor 22, to the processing device 12. In this embodiment, when the swivel levers 52 are in the takeover region 18, the swivel levers 52 are swiveled back into their takeover position. Consequently, the mouths 26 of the clamps 20 are forward in rotating direction U.

As particularly illustrated in FIGS. 1 and 10, the shape of the control link 76 causes the swivel levers 52 to be swiveled forward when they are in the region following the takeover region 18. When the swivel levers 52 reach the transfer region 28, they run approximately in the radial direction. The four-bar linkage-like control of the swivel position of the clamps 20 by the guiding bars 64 causes the clamps 20 to swivel in the rotational direction S, opposite to the rotating direction U. Thus, at the beginning of the transfer region 28, the clamp mouth 26 is directed opposite of the respective receiving part 34 of the processing device 12. At the same time, the transfer conveyor 22 and the processing device 12 are synchronized so that a clamp 20 reaching the transfer region 28 lies approximately between two walls 36 and a receiving part 34, seen in rotating direction V of the drum-like processing device 12. In the transfer region 28, the clamp speed $v_2$ is greater than the circumferential speed $v_3$ of the rests 38 on the processing device. Therefore, the clamp 20 catches up with the leading wall 36. In this case, the product 10 rests against either wall 36 or a printing product 40 located on this wall 36. Opening the respective clamp 20 releases the product. Various possibilities of transferring the products 10 onto the processing device 12 are now described in further detail with reference to FIGS. 11 to 15.

Figure 11:
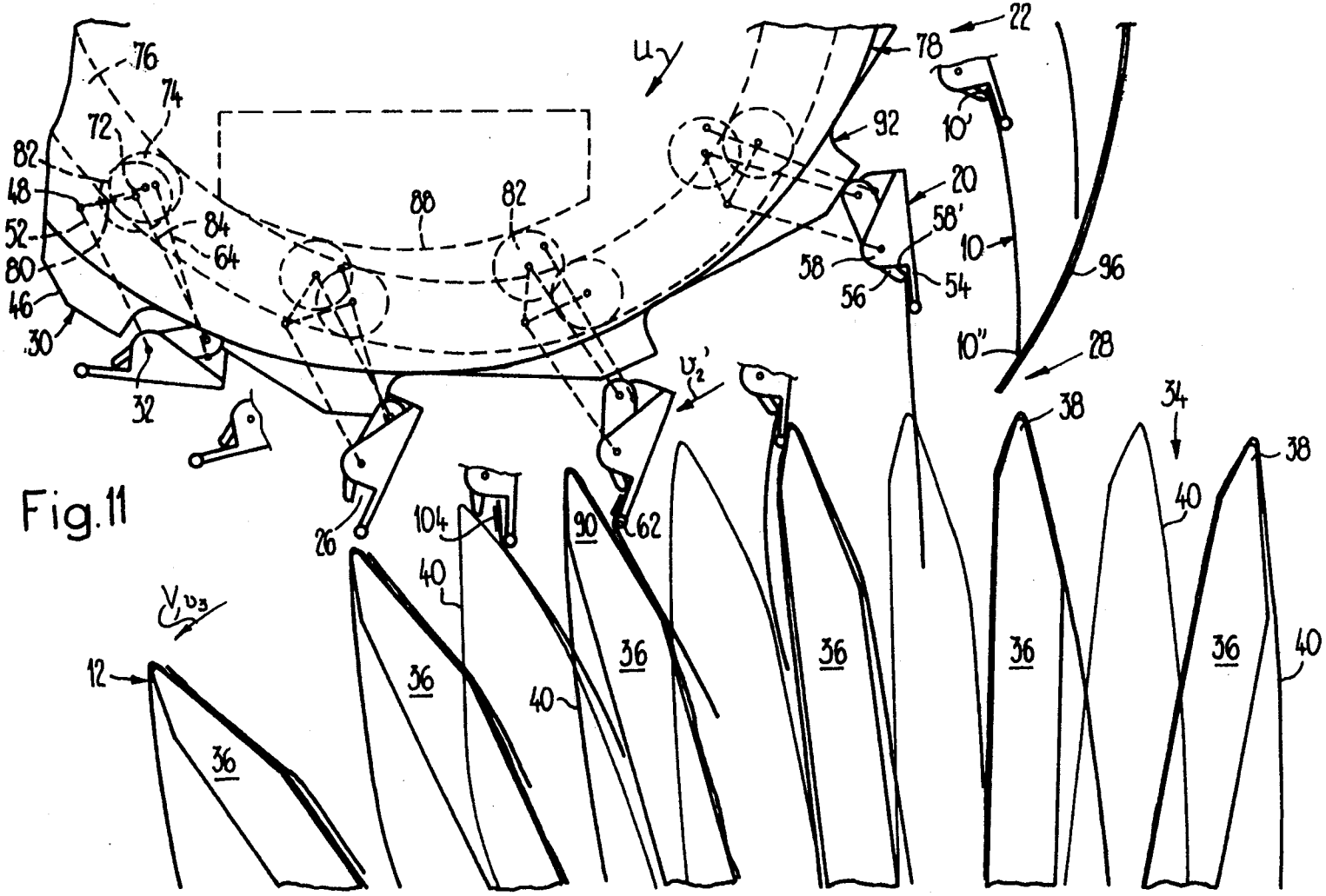
FIG. 11 is an enlarged view of another embodiment of the present invention.

FIG. 11 is an enlarged illustration of the transfer conveyor 22 and processing device 12 depicted in FIG. 1. The position of a clamp 20, feeding a product 10 to the processing device 12, and a printing product 40, resting on a wall 36 of the processing device 12, are shown half a working cycle apart. The position of the clamp 20 with respect to the full working cycle is shown. Where only half a working cycle has elapsed only part of the clamp 20 is shown. Likewise, the wall 36 is shown only in the position it assumes at the full working cycle. In between, only the printing product 40 is indicated.

The leading edge 10'' of product 10, held by the clamp 20, slides along the guide plate 96. The guide plate 96 ends a short distance from the circulating path of the rests 38. The processing device 12 and the transfer conveyor 22 are synchronized in such a way that the product's 10 leading edge 10'' projects into a receiving part 34 at a central location. When the clamp 20 initially approaches the transfer region 28, the swivel lever 52 is not yet completely swiveled into the transfer position. The remaining residual swiveling movement results in the product 10 being inserted with increased speed into the receiving part 34. At the same time, the difference between the clamp speed $v_2$ and rotating speed $v_3$ of the rest 38 is increased. The clamp 20 advances to the leading wall 36 in the transfer region 28 and presses the product by its pressing roller 62 against the printing product 40. The printing product 40 is supported by the wall 36 which acts as a counter bearing 90. Since the clamp speed $v_2$ is greater than the rotating speed $v_3$, the first clamping jaw 54 is swiveled counter-clockwise, against the force of the spring element 68. The follow-up link 88, interacts with the follow-up roller 82. The second clamping jaw 56 is resiliently prestressed against the counter bearing 90. During further movement, the pressing roller 62 rolls on the product 10 and presses the adhesive 104 against the printing product 40 resulting in a secure adhesion. As soon as the pressing roller 62 runs off the wall 36, the clamp 20 closes to the extent permitted by the guiding bar 64 and the follow-up link 88. When the follow-up roller 82 runs off the follow-up link 88, the clamp 20 is fully closed. After leaving the transfer region 28, the swivel lever 52 swivels back into the takeover position. Hence, the clamp jaw 26 is directed forward in rotating direction U. The clamp 20 is open when it approaches the takeover region 18 due to the action of the opening link 86. Consequently, the clamp 20 is ready for the seizing of a product 10.

The embodiment depicted in FIG. 10 functions in the same manner as described above with one exception: during the pressing of the product 10 against the counter bearing 90, the free end region of the first clamping jaw 54 acts as a sliding shoe.

Figure 12:
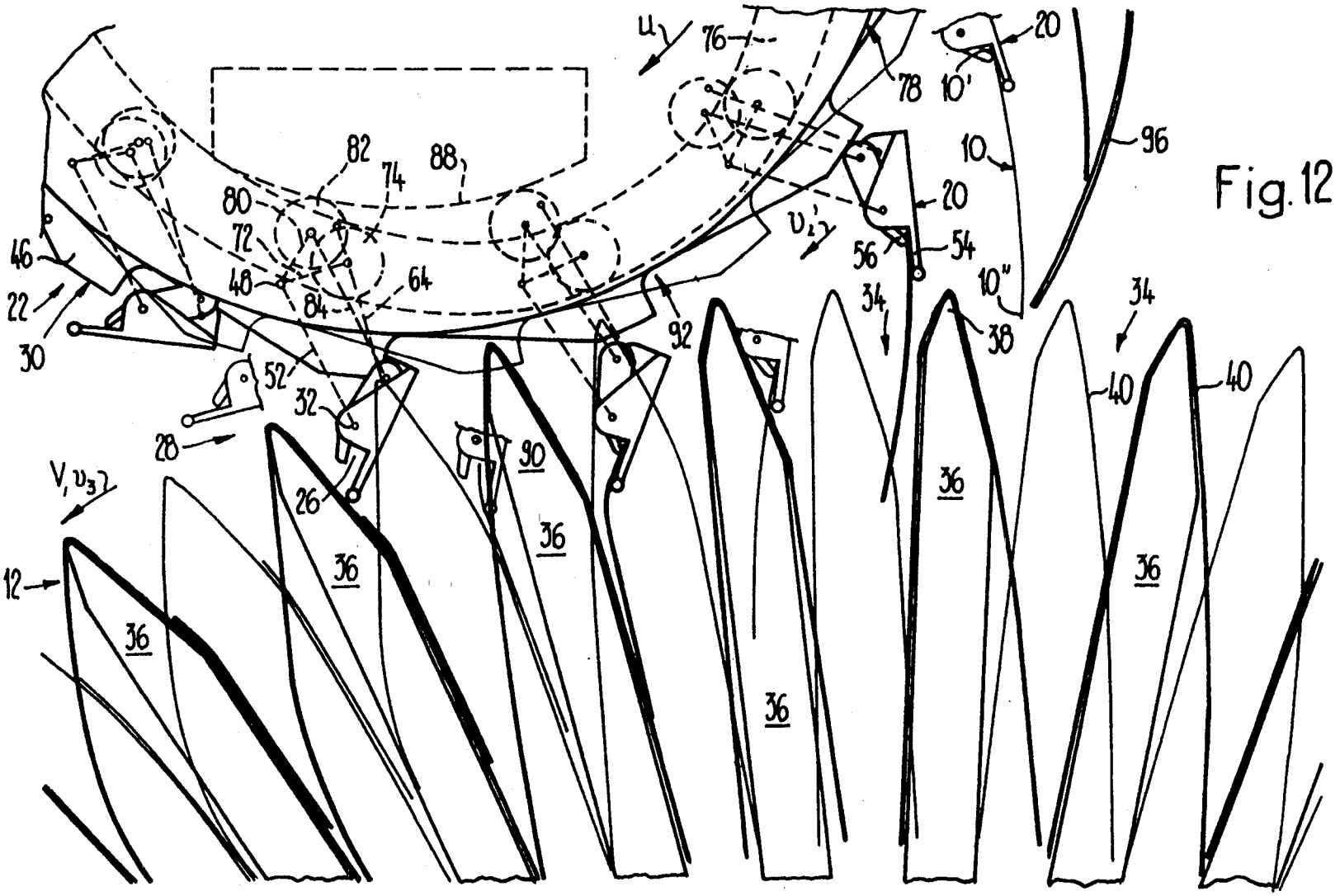
FIG. 12 is an enlarged view of another embodiment of the present invention.

FIG. 12 corresponds with FIG. 11, the sole difference being that the distance between the axis of rotation 24 of the transfer conveyor 22 (see FIG. 1) and the axis of rotation of the processing device 12 is reduced. This results in the clamps 20 engaging deeper into the receiving parts 34. This, in turn, causes the products 10 to adhesively attach to the printing products 40 at a different point. As a consequence, the rests 38 engage the recesses 92 of the carrying disks 46 without making contact.

Figure 13:
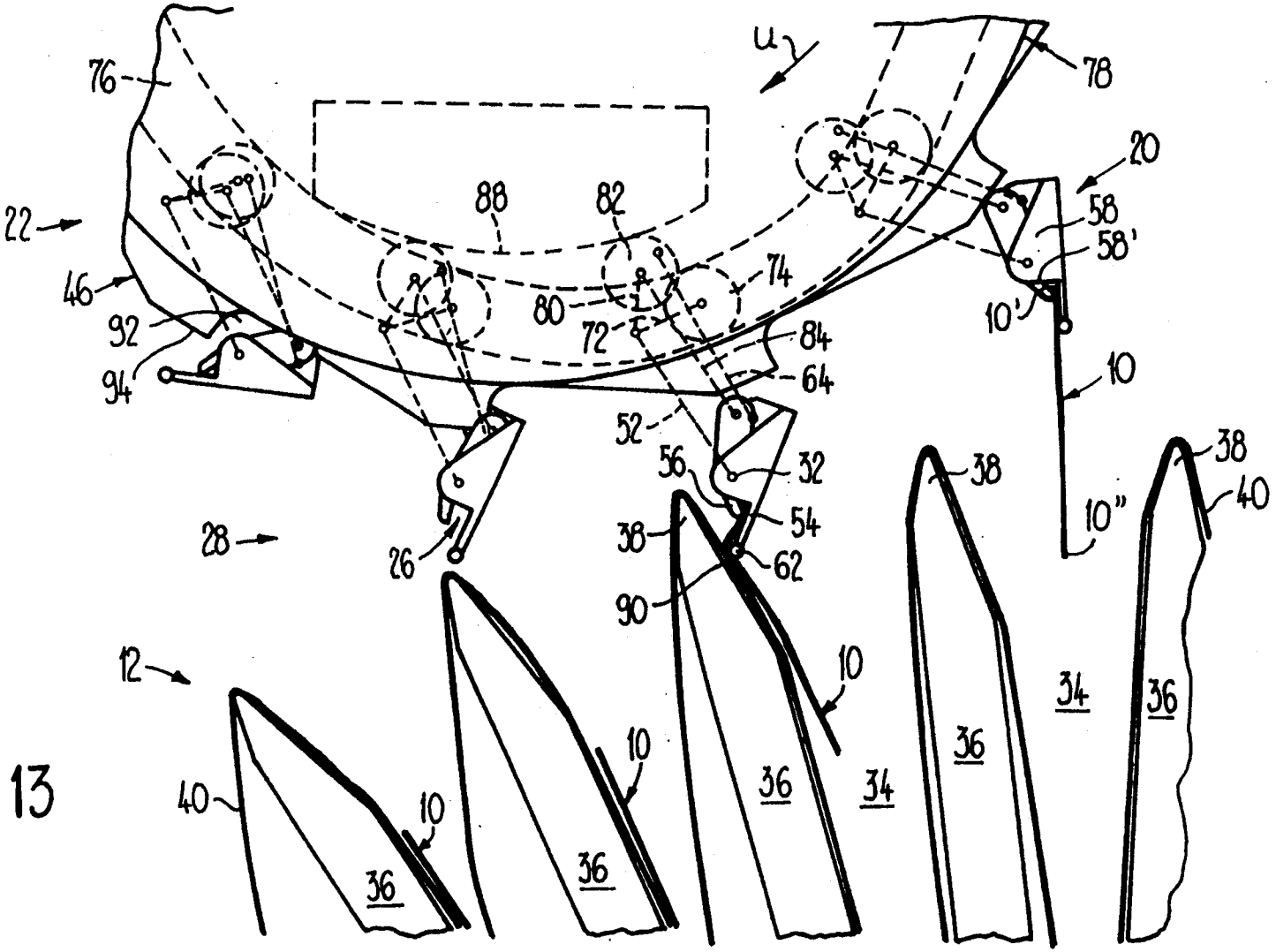
FIG. 13 is an enlarged view of another embodiment of the present invention.

FIG. 13 illustrates the transfer conveyor 22 and the drum-like processing device 12 according to FIG. 1, enlarged in the transfer region 28. Here, however, the products 10 are not provided with an application of adhesive. The products 10 are inserted with their leading edge 10'' forward into a receiving part 34 of the processing device 12. The respective clamp 20 in turn advances to the leading wall 36 and presses the product 10, with its pressing roller 62 against the printing product 40. The printing product 40 is supported by the wall 36, which acts as a counter bearing 90. The clamp 20 opens due to the effect of the counter bearing 90 which causes the first clamping jaw 54 to swivel in a counter-clockwise direction against the action of the spring element 68. The second clamping jaw 56 is prevented from swiveling by the follow-up link 88. As soon as the pressing roller 62 has rolled off the product 10, the product 10 drops into the bottom of the receiving part 34.

Figure 14:
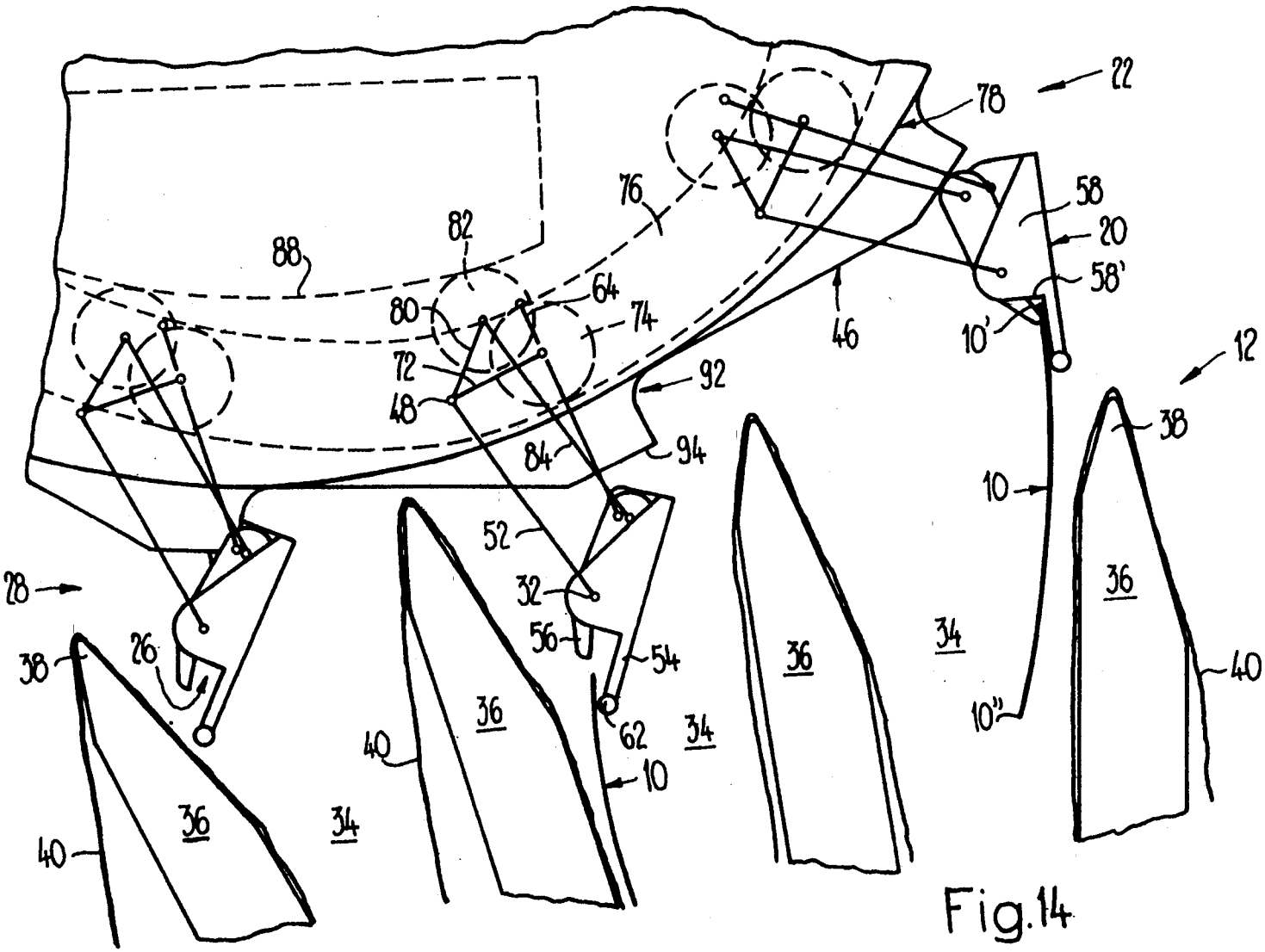
FIG. 14 is an enlarged view of another embodiment of the present invention.

It is also possible to open the clamp 20 in a controlled manner by utilizing the follow-up link 88 in the transfer region 28. As indicated in FIG. 14, a clamp 20 holds product 10 at the trailing edge 10', and inserts the product's leading edge 10'' into a receiving part 34. The phase position between the transfer conveyor 22 and the drum-like processing device 12 is set so that the clamps 20 approach the leading wall 36, but do not completely meet in the transfer region 28. When swivel lever 52 swivels into the transfer position and clamp 20 is also in the transfer position, the follow-up roller 82 runs onto the follow-up link 88. The follow-up link 88 acts as an opening link and is designed so the second clamping jaw 56 is swiveled into the open position. The stop disk 70 projects onto the bearing element 60 (FIG. 4), thereby causing the first clamping jaw 54 to retain its position with respect to the swivel lever 52. The product 10, released by the opening of the clamp mouth 26, drops into the interior of the receiving part 34.

Another variation of the apparatus enables adhesive attachment or insertion of product 10 to printing products which are not deposited astride rests 38. In this embodiment, the printing products are inserted into the receiving parts 34, if appropriate with their fold ahead.

Figure 15:
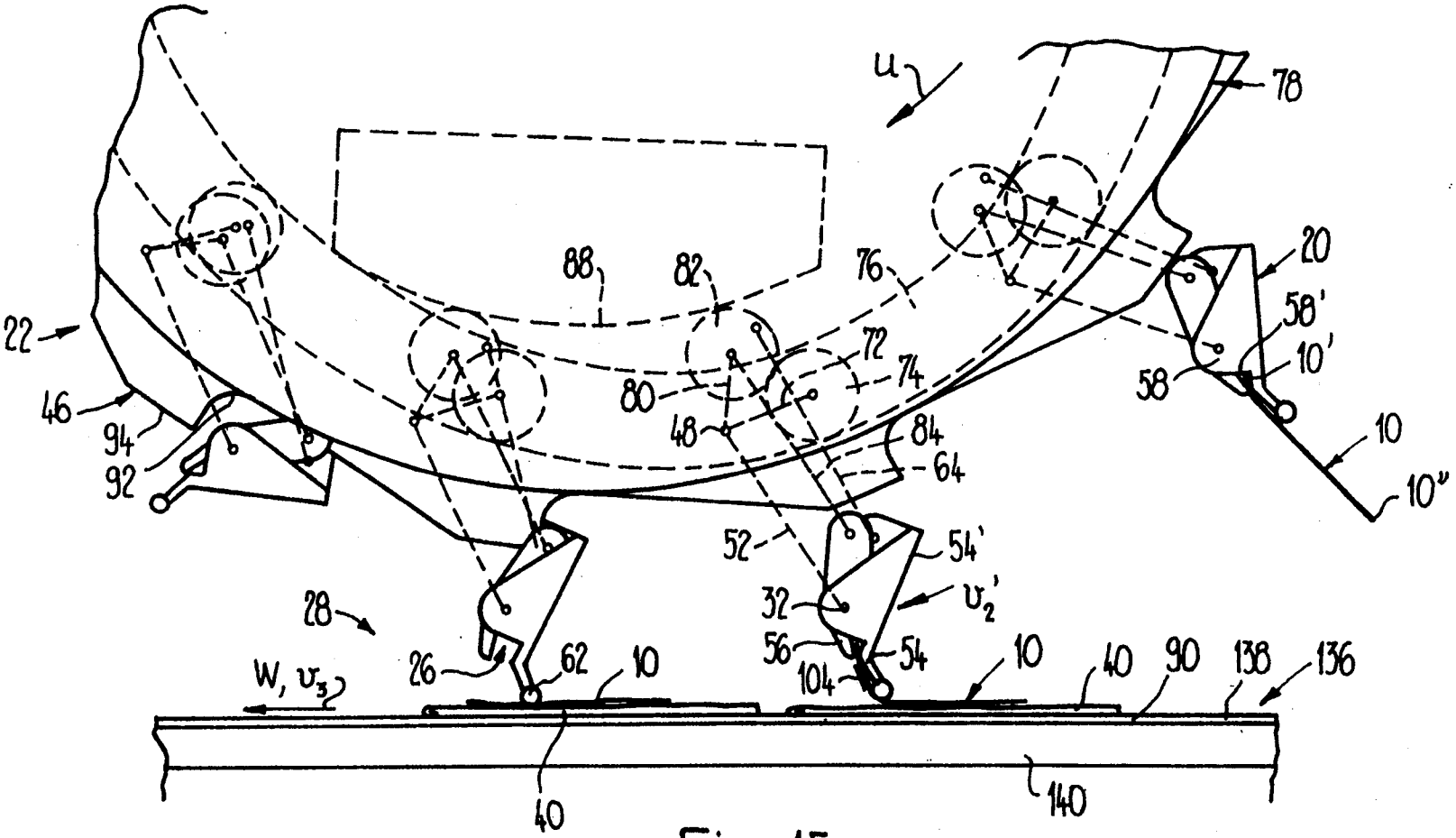
FIG. 15 is a perspective view of another embodiment of the present invention.

Turning now to FIG. 15, the processing device 12 has a processing conveyor 136. The conveyor belt 138 of the processing conveyor 136 is driven in the transfer region 28 in conveying-away direction W, which is the same as the rotating direction U. The conveying-away speed $v_3$ is less than the rotating speed $v_2$ of the pressing rollers 62 in the transfer region 28. Printing products 40 rest on the conveyor belt 138. Product 10 is deposited onto each of the printing products 40 and, if appropriate, adhesively attached. On the side facing away from the transfer conveyor 22, the conveyor belt 138 is supported by means of a supporting element 140. This supporting element 140 enables the conveyor belt 138 to serve as counter bearing 90. The transfer conveyor 22 is the same as that shown in previous Figures with one exception: the clamping jaw part 54' of the first clamping jaw 54 possesses an offset design. Therefore, part 54' projects beyond the second clamping jaw 56. The pressing roller 62 is located at the free end of clamping jaw part 54'. The pressing roller 62 is rearwardly bent in the radial direction when swivel lever 52 is in the transfer position. The guide plate 96 is omitted in this embodiment.

The products 10 are deposited by the transfer conveyor 22 onto the printing products 40. Due to the swiveling movement of the clamps 20, the leading edge 10'' of the products 10 becomes the trailing edge 10'. The circulating path of the pressing rollers 62 is not altered and therefore intersects the conveyor belt 138. The pressing roller 62 then, under the force of the spring element 68, presses the product 10 against the printing product 40. This causes the first clamping jaw 54 to swivel in the counter-clockwise sense. Because of the effect of the counter bearing 90, the conveyor belt 138 cannot evade the effect of the first clamping jaw 54. The follow-up link or cam 88 prevents the second clamping jaw 56 from following the swiveling movement of the first clamping jaw 54, whereby the clamp 20 is opened. The product 10 is pressed against the printing product 40 by the pressing roller 62. Once the product 10 has been provided with an application of adhesive 104, a secure adhesive bond results. If no adhesive 104 is applied on the product 10, the product 10 is securely guided onto the corresponding printing product 40. If a printing product 40 is not present, the product 10 is deposited onto the conveyor belt 138.

Yet another variation of the invention lies in designing the control link or cam 76 in such a way that the swiveling of the swivel levers 52 out of the transfer position and back into the takeover position begins in the transfer region 28, while the pressing of the product 10 is still in progress.

The distance between the clamps 20 is greater than the distance between the trailing edges 10' of the products 10 fed to the takeover region 18. Similarly, the distance between the clamps 20 in the transfer region 28 is greater than the distance between the rests 38. It is, however, also conceivable for the advancing of the wall 36, which is ahead of a clamp 20, to take place solely because of the swiveling movement of the swivel levers 52.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, the scope of the invention is, therefore, indicated by the appended claims rather than by the foregoing description. All changes which come within the meaning and range of equivalency of the claims are to be embraced within their scope.

I claim

1. An apparatus for delivering sheet-like products to a device for processing printed products comprising:

a conveying device having a conveying direction, the conveying device transporting the products with a trailing edge running transversely to the conveying direction;

a rotating transfer conveyor located adjacent said conveying device, the transfer conveyor receiving the products from said conveying device in a takeover region and transporting the products to a transfer region;

a processing device, located adjacent said transfer conveyor and opposite said conveying device, the processing device receiving the products from said transfer conveyor in the transfer region;

the rotating transfer conveyor comprising at least one controllable clamp articulated about a swivel axis on a swivel lever;

the swivel lever being articulated about an articulation axis on a carrying member rotating in a rotating direction, the articulation axis and swivel axis running substantially parallel and transverse to the rotating direction, the rotating direction being such that in the takeover region the clamp is running substantially in the conveying direction;

the clamp having a clamp mouth for seizing the products, and the clamp mouth being directed in the takeover region, in the rotating direction for seizing the products at their trailing edge; and during movement of the clamp away from the takeover region in the rotating direction to the transfer region, the swivel lever being rotated about the articulation axis in the rotating direction and the clamp being pivoted about the swivel axis counter to the rotating direction.

2. The apparatus according to claim 1 wherein said transfer conveyor further comprises a wheel-like carrying member which supports said controllable clamp.

3. The apparatus according to claim 2 wherein said transfer conveyor further comprises a linkage, connected to the clamp and the carrying member, controlling the position of the clamp depending on the position of the swivel lever.

4. The apparatus according to claim 2 wherein said transfer conveyor further comprises:

at least one guiding bar rotatably mounted on said carrying member, wherein said swivel lever and said guide bar form a linkage which articulates said clamp on the carrying member and the position of the clamp is controlled depending on the position of the swivel lever.

5. The apparatus according to claim 4 wherein said clamp comprises:

a first clamping jaw connected to said guide bar; and a second clamping jaw rotatably mounted on said swivel spindle, the second clamping jaw prestressed, in the closed direction, relative to the first clamping jaw, the first clamping jaw projecting beyond the free end of the second clamping jaw and, in the takeover region, being radially outerlying with respect to the second clamping jaw.

6. The apparatus according to claim 5 wherein the guide bar is displaceably articulated on the carrying member and further comprising a spring element which engages the guiding bar and prestresses said second clamping jaw toward said first clamping jaw.

7. The apparatus according to claim 6 wherein the processing device further comprises a counter bearing attached to the processing device for opening the first clamping jaw.

8. The apparatus according to claim 7 wherein the transfer conveyor further comprises:

at least one follow-up roller rotatably mounted between the carrying member and the swivel lever; and at least one follow-up link which interacts with the follow-up roller to prevent swiveling of the second clamping jaw when the first clamping jaw is opened by the counter bearing.

9. The apparatus according to claim 8 further comprising a pressing roller mounted on the free end of the first clamping jaw for pressing the product against a printing product resting on the counter bearing and rolling over the product when the clamp is open.

10. The apparatus according to claim 1 further comprising an adhesive applying device upstream of the conveying device, said adhesive applying device providing an application of adhesive on the product.

11. The apparatus according to claim 10 where the adhesive is applied on the products, at a point which, with the product held by the clamp, comes to lie between the trailing edge and a free end of a first clamping jaw on the side of the product facing away from the first clamping jaw.

12. The apparatus according to claim 1 wherein said processing device comprises a plurality of rests for receiving the products, the rests extending in the direction of a horizontal axis at fixed intervals from one another and rotating in the direction of the horizontal axis.

13. The apparatus according to claim 5 wherein said processing device comprises a belt conveyor supported in the transfer region to form a counter bearing for the products.

14. The apparatus according to claim 1 wherein said conveying device further comprises a flexible conveyor belt in the takeover region driven at a conveying speed, and wherein the clamp is driven at a clamp speed greater than the conveying speed, and the clamp comprises a first clamping jaw facing the conveyor belt which presses as product to be seized by a following clamp against the conveyor belt firmly enough for the product to be taken along.

15. The apparatus as claim in claim 1 wherein the transfer conveyor further comprises at least one link-like control means for controlling the clamp.

16. The apparatus as in claim 4 comprising a control member which swivels the swivel levers depending on the rotary position of the carrying member, the swivel levers having a longitudinal extent and being swiveled by the control member out of a takeover position, which the swivel levers assume in the takeover region, wherein the longitudinal extent of swivel lever is swiveled-back with respect to the radial direction, into a transfer position which the swivel levers assume in the transfer region, wherein the longitudinal extent of the swivel levers runs approximately in the radial direction.

17. An apparatus for transporting sheet-like products comprising:

a continuously circulating belt conveyor having a flexible conveyor belt for transporting the products driven in a conveying direction at a conveying speed;

a takeover conveyor having a rotating carrying member driven in a second rotating direction;

said takeover conveyor including a plurality of clamps mounted on the carrying member and adapted to rotate with the carrying member at a clamp speed;

said belt conveyor circulating and said clamps rotating through a takeover region between them wherein the products are transferred from the conveyor belt to the clamps; and each of the clamps pressing the products to be seized by the adjacent clamp against the conveyor belt.

18. The apparatus according to claim 17 wherein each of the clamps presses the products to be seized by the next following clamp against the conveyor belt.

* * * * *